US005363926A

United States Patent [19]

Mizuno

[11] Patent Number: 5,363,926

[45] Date of Patent: Nov. 15, 1994

[54] DEVICE FOR DETECTING INCLINATION OF BORING HEAD OF BORING TOOL

[75] Inventor: Morio Mizuno, Iwakura, Japan

[73] Assignee: Takachiho Sangyo Kbushiki Kaisha, Nagoya, Japan

[21] Appl. No.: 176,423

[22] Filed: Jan. 3, 1994

[30] Foreign Application Priority Data

Sep. 21, 1993 [JP] Japan ..... 5-234843

[51] Int. Cl.[5] ..... E21B 47/00

[52] U.S. Cl. ..... 175/45

[58] Field of Search ..... 175/24, 45, 61, 62; 405/184; 324/345, 346

[56] References Cited

U.S. PATENT DOCUMENTS 4,907,658 3/1990 Stangel et al. ..... 175/45 X
5,002,137 3/1991 Dickinson et al. ..... 175/45 X
5,165,490 11/1992 Nosaka .
5,203,418 4/1993 Gibson et al. ..... 175/45

*Primary Examiner*—Michael Powell Buiz
*Attorney, Agent, or Firm*—Palmatier, Sjoquist & Helget

[57] ABSTRACT

A boring head of a boring tool for boring the ground includes a device for detecting inclination of the boring head therein. The device includes a roll angle sensor and a pitch angle sensor. The roll angle sensor detects an angular position of the boring head in a roll direction and outputs a roll angle detecting signal. The pitch angle sensor detects an angular position of the boring head in a pitch direction outputs a pitch angle detecting signal. A signal modulating circuit converts the roll angle detecting signal and the pitch angle detecting signal into a serial signal and modulates the serial signal. An output circuit receives the modulated serial signal and outputs a magnetic field which is receivable by a receiver located on the ground and which permits determination of the roll angle and the pitch angle of the boring head.

4 Claims, 10 Drawing Sheets

DEVICE FOR DETECTING INCLINATION OF BORING HEAD OF BORING TOOL

BACKGROUND OF THE INVENTION

1. Field of the Invention

The present invention relates to a device for detecting inclination of a boring head of a boring tool which is used to install pipelines under the ground without digging a trench.

2. Description of the Prior Art

When the ground is bored by a boring tool to install pipelines under the ground without digging a trench, it requires to grasp both horizontal and vertical positions of a boring head during the boring operation so as to correct the deviation relative to a planned course.

U.S. Pat. No. 5,165,490 in the name of the same assignee of the present application has proposed a device for detecting an angular position in a circumferential direction of a boring head having a slant surface as a reference surface. With the device of this U.S. patent, a magnetic field is intermittently generated from the boring head when the slant surface is positioned out of a predetermined angular range, while the magnet field is continuously generated when the slant surface is positioned within the predetermined angular range. Such a magnetic field is received by a receiver on the ground, and the receiver displays as to whether the inclination of the boring head in the circumferential direction is proper or improper. If the receiver displays that the inclination is improper, the boring head is rotated to correct the position of the slant surface so as to coincide with a reference angle, and a further correction is performed to correct the direction so as to correspond to a planned course.

With this prior art detecting device, however, although it can be operated to detect as to whether the inclination in the circumferential direction of the boring head is within the proper range, it cannot be operated to detect the inclination itself or an exact inclination angle in a rolling direction. Further, the prior art device cannot be operated to detect the inclination angle in an axial direction of the boring head or an inclination angle in a pitch direction. Therefore, the device is not operable to reliably correct the inclination according to the planned course, and it requires troublesome operation for such a correction.

SUMMARY OF THE INVENTION

It is, accordingly, an object of the present invention to provide a device for detecting inclination of a boring head which is operable to reliably detect both angles in a roll direction and a pitch direction.

It is also an object of the present invention to provide a device for detecting inclination of a boring head which is operable to reliably correct the position of the boring head to correspond to a planned course of boring.

According to the present invention, there is provided a device mounted on a boring head of a boring tool for boring the ground and adapted for detecting inclination of the boring head, comprising:

a roll angle sensor for detecting an angular position of the boring head in a roll direction and for outputting a roll angle detecting signal;

a pitch angle sensor for detecting an angular position of the boring head in a pitch direction and for outputting a pitch angle detecting signal;

a signal modulating circuit for converting the roll angle detecting signal and the pitch angle detecting signal into a serial signal and for modulating the serial signal; and an output circuit for receiving the modulated serial signal and for outputting a magnetic field which is receivable by a receiver located on the ground and which permits determination of the roll angle and the pitch angle of the boring head.

The invention will become more apparent from the appended claims and the description as it proceeds in connection with the drawings.

DETAILED DESCRIPTION OF THE PREFERRED EMBODIMENT

An embodiment of the present invention will now be explained with reference to the accompanying drawings.

Figure 1:
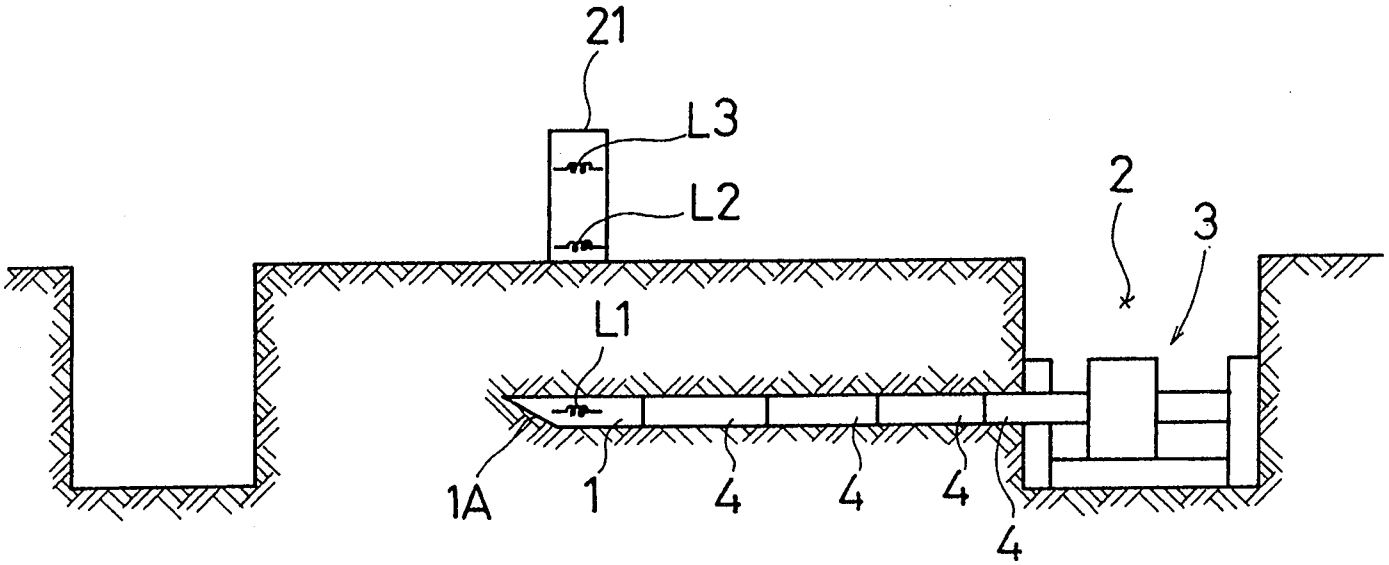
FIG. 1 is a schematic view showing a general arrangement of an inclination detecting system of a boring head according to an embodiment of the present invention.

Referring to FIG. 1, there is shown a general arrangement of an inclination detecting system of a boring head 1. As shown in FIG. 1, the boring head 1 is driven by a boring tool 3 placed in a starting pit 2 so as to bore the ground. A plurality of pilot tubes 4 are in turn connected to the boring head 1 as the boring head 1 is moved Forwardly.

An output coil L1 is disposed within the boring head 1 and is positioned in parallel with an axial direction of the boring head 1.

The output coil L1 is operable to output a magnetic field corresponding to angles in a roll direction and a pitch direction of the boring head 1 as will be explained later.

A receiver 21 is located on the ground and includes two receiving coils L2 and L3 for receiving the magnetic field outputted from the output coil L1. The details of the receiving coils L2 and L3 will be explained later.

Figure 2:
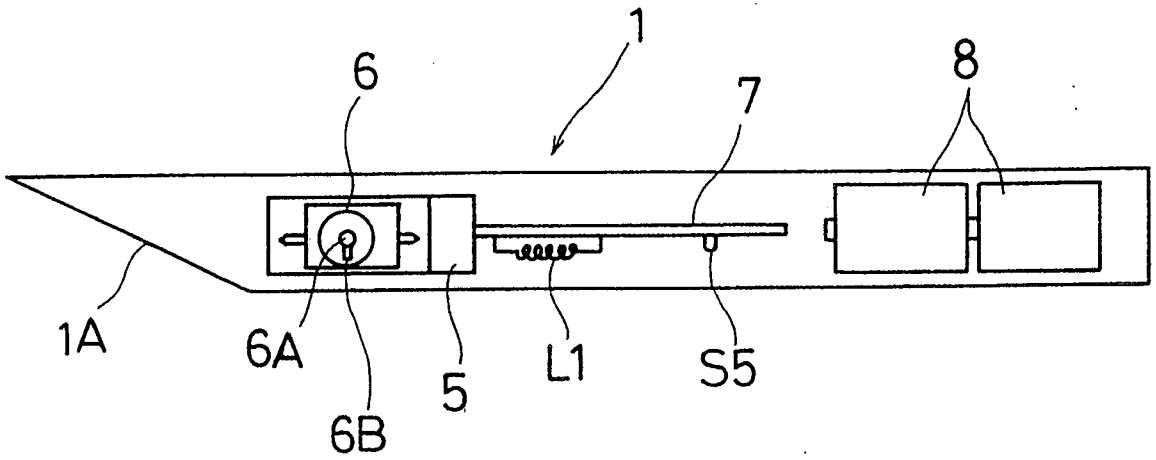
FIG. 2 is an enlarged sectional view of the boring head shown in FIG. 1.

FIG. 2 is a schematic sectional view of the boring head 1 and shows an arrangement of various elements disposed within the boring head 1. As shown in FIG. 2, the boring head I includes therein a roll angle sensor 5 for detecting the angle in the roll direction of the boring head 1 and a pitch angle sensor 6 for detecting the angle in the pitch direction of the same. The boring head 1 further includes a printed circuit board 7 and a battery 8. As will be explained later, an electronic circuit is formed on the circuit board 7 and receives a supply of power from the battery 8.

Figure 3A:
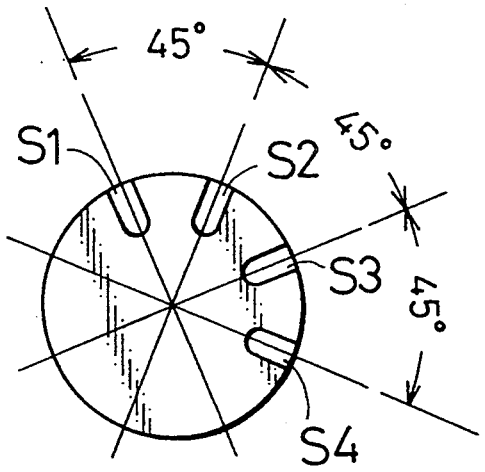
FIG. 3(A) is a view showing an arrangement of mercury switches of a roll angle sensor.
Figure 3B:
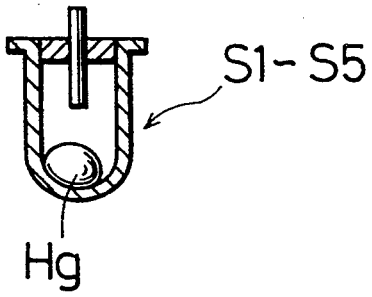
FIG. 3(B) is a sectional view of one of the mercury switches shown in FIG. 3(A)

As shown in FIG. 3(A), the roll angle sensor 5 includes mercury switches S1, S2, S3 and S4 which are spaced from each other by an angle of 45° in a circumferential direction. As shown in FIG. 3(B), a drop of mercury Hg is sealingly contained in each of the mercury switches S1 to S4. The mercury switches S1 to S4 are positioned such that only the mercury switch S4 is turned on when a slant surface 1A of the boring head 1 is turned downwardly, while the other mercury switches S1, S2 and S3 are turned off.

The pitch angle sensor 6 utilizes a variable magnetic resistor (not shown) and includes a pivotal shaft 6A and a weight 6B fixed to the pivotal shaft 6A. According to the inclination of the boring head 1 in the pitch direction, the pivotal shaft 6A is pivoted relative to the boring head 1 with the weight 6B being normally kept in the direction of gravity. A voltage corresponding to the pitch angle of the boring head 1 is therefore outputted from the pitch angle sensor 6. Here, a conventional potentiometer can be used in place of the variable magnetic resistor.

FIGS. 4 to 8 show the electronic circuit formed on the circuit board 7.

Figure 4:
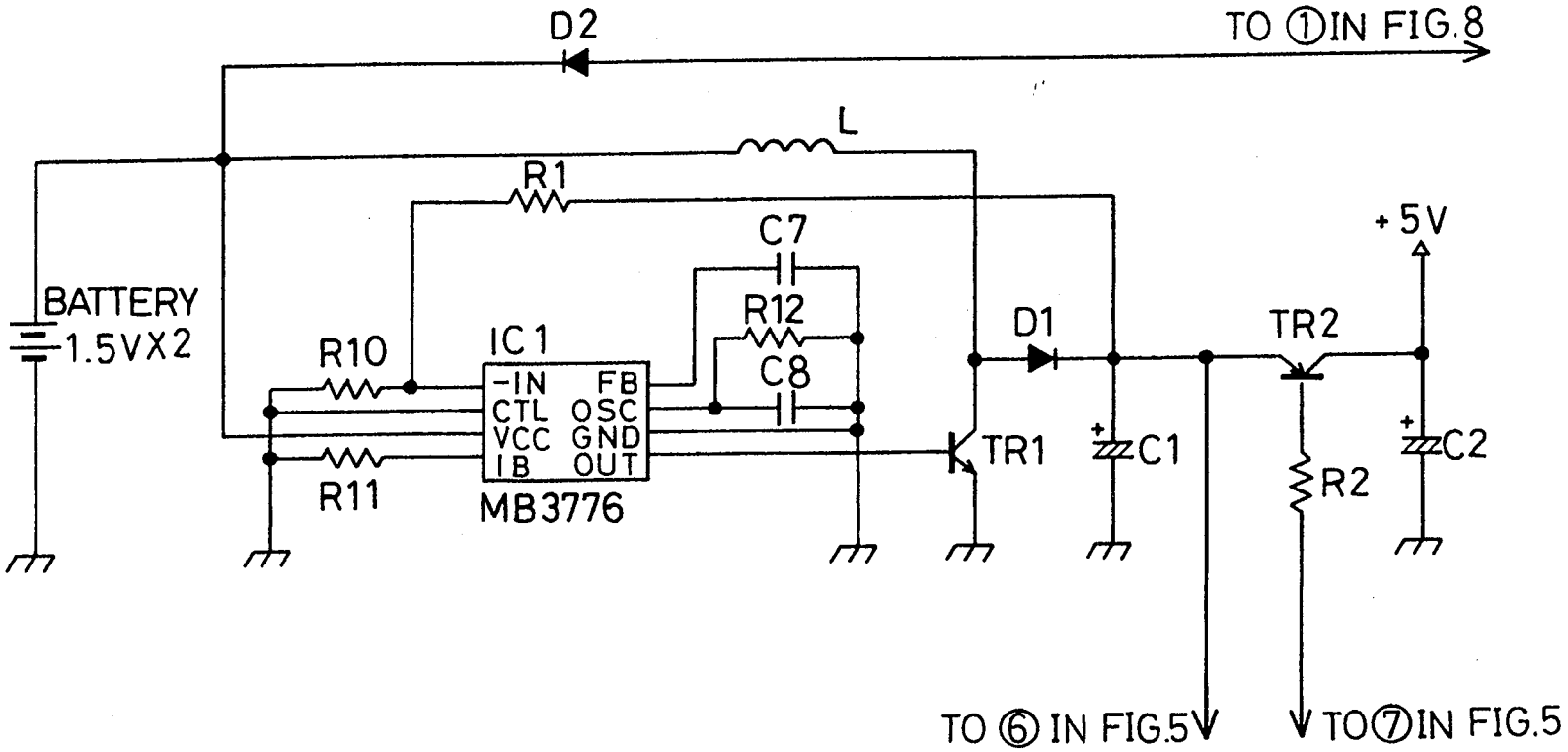
FIG. 4 is a circuit configuration of a power supply circuit.
Figure 5:
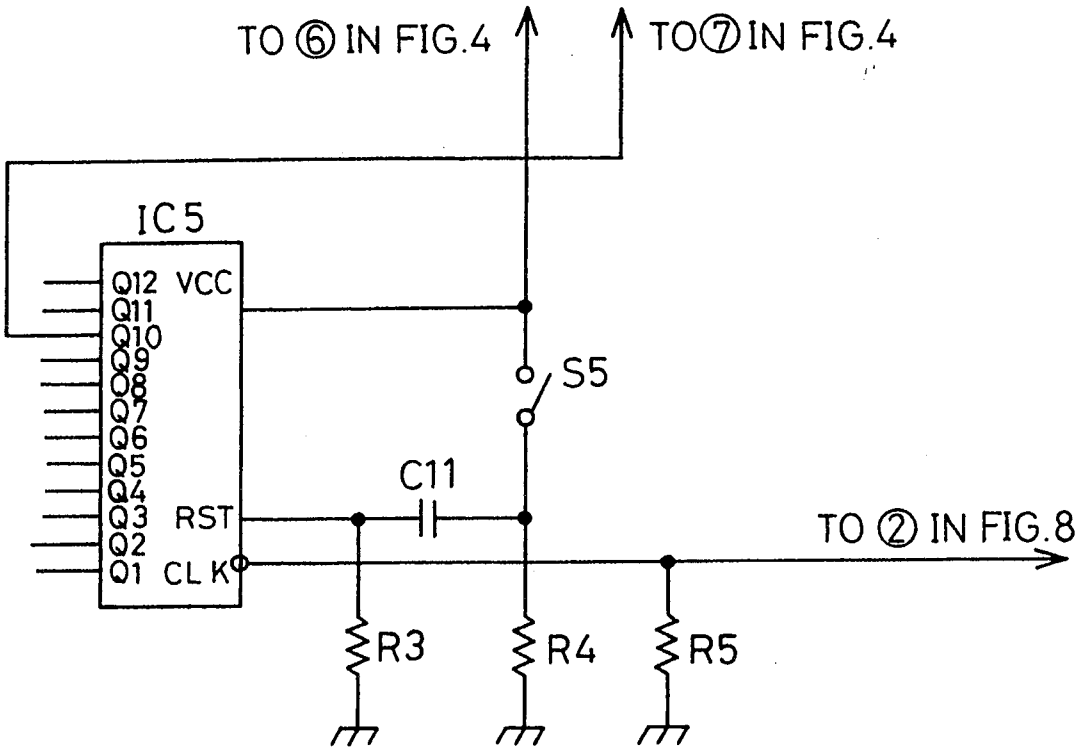
FIG. 5 is a circuit configuration of a power-saving circuit.

FIG. 4 shows a power supply circuit in which a voltage of 3 V from the battery 8 is applied to an IC1 for a switching power source so as to produce a pulse of high frequency which is applied to a transistor TR1 for switching the same. A coil L, a diode D1 and a capacitor C1 are provided to produce a DC voltage of 5 V required for operation of the electronic circuit. A transistor TR2 is operable to interrupt the supply of the DC voltage of 5 V when a power-saving signal from a power-saving circuit shown in FIG. 5 is outputted. The power supply circuit is connected to a control circuit shown in FIG. 8 as indicated by TO ① IN FIG. 8, and is also connected to the power-saving circuit shown in FIG. 5 as indicated by TO ⑥ IN FIG. 5 and TO ⑦ IN FIG. 5.

Figure 8:
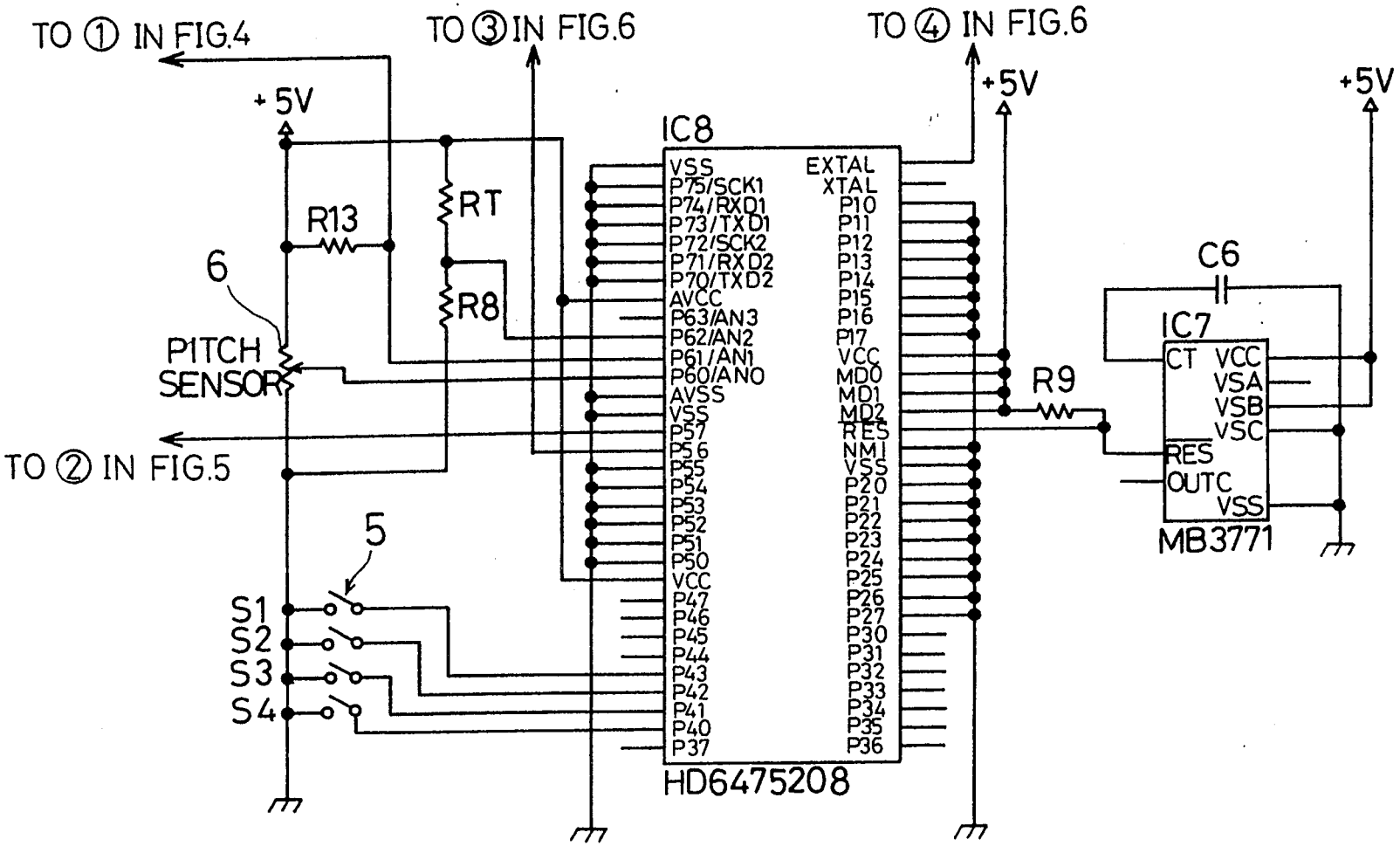
FIG. 8 is a circuit configuration of a control circuit.

In the power-saving circuit shown in FIG. 5, when a pulse signal from the control circuit shown in FIG. 8 is inputted to a clock input terminal CLK of a counter IC5, the counter IC5 divides the frequency of the pulse signal and outputs a frequency-divided signal from a terminal Q11. The frequency-divided signal is then applied to the base of the transistor TR2 of the power supply circuit. The clock input terminal CLK is connected to the control circuit shown in FIG. 8 as indicated by TO ② IN FIG. 8.

One of two terminals of the mercury switch S5 is connected to a reset terminal RST of the counter IC5 via a capacitor C11, while the other terminal of the mercury switch S5 is connected to a power source terminal Vcc of the counter IC5. The mercury switch IC5 is turned on and off for each revolution of the boring head 1 and a reset pulse is inputted, via the capacitor C11, to the reset terminal RST instantaneously with turning on of the mercury switch IC5.

When the reset pulse is inputted to the reset terminal RST, all of the frequency-divided outputs of terminals Q1 to Q12 become logic "0", so that the transistor TR2 of the power supply circuit is switched on to supply power to its related circuits. When the revolution of the boring head 1 is stopped and the reset pulse is no more inputted to the mercury switch IC5, the related circuits are operated until the frequency-divided output of the terminal Q11 becomes logic "1" through inputting of the pulse signal from the control circuit shown in FIG. 8 to the clock input terminal CLK. The transistor TR2 of the power supply circuit is thereafter switched off to provide a power-saving condition.

Figure 6:
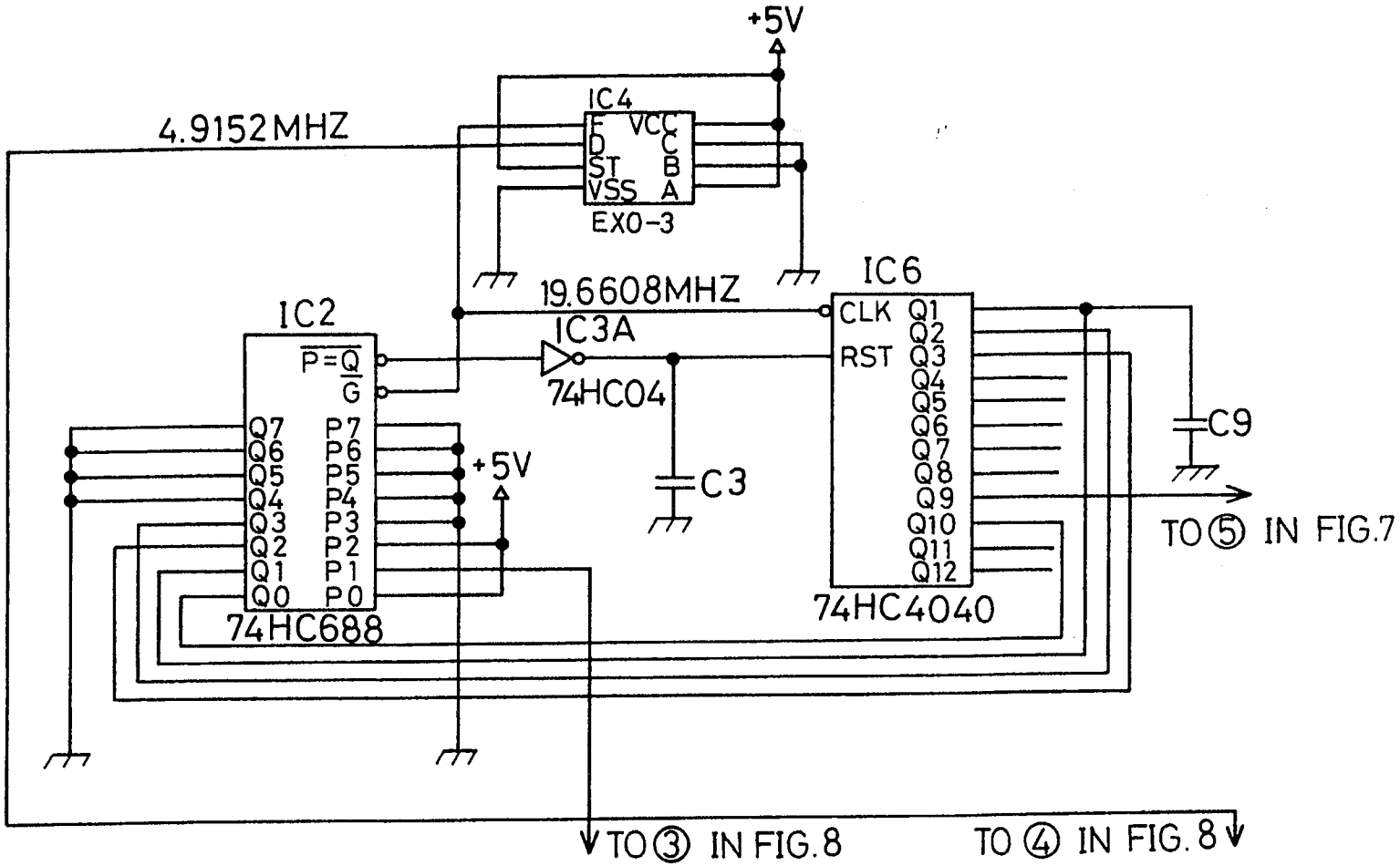
FIG. 6 is a circuit configuration of an oscillating circuit.

An oscillator circuit shown in FIG. 6 includes a crystal oscillator IC4 having a divider circuit therein. The oscillator IC4 has an output terminal F for outputting a signal of 19.6608 MHz as a reference oscillation frequency. The signal of 19.6608 MHz is inputted to an input terminal G of a comparator IC2 and to a clock input terminal CLK of a counter IC6.

A signal of 4.9152 MHz is a fraction of the signal of 19.6608 MHz into four divisions and is outputted to an output terminal D of the oscillator IC4. The signal of 4.9152 MHz is inputted to the control circuit shown in FIG. 8 as indicated by TO 4 IN FIG. 8.

Output terminals Q1, Q2, Q3 and Q10 of the counter IC6 are connected to input terminals Q1, Q2, Q3 and Q0 of the comparator IC2, respectively. With regard to the output terminals Q1, Q2, Q3 and Q10 of the counter IC6, on the condition that the output of the terminal Q2 becomes logic "0", the outputs of the terminals Q3 and Q10 become logic "1", and that the output of the terminal Q1 becomes to coincide with logic "0" or "1" of a terminal P1 for inputting of the signal from the control circuit, an output terminal P=Q of the comparator IC2 becomes logic "0". An output of an inverter IC3A connected to the terminal P=Q of the comparator IC2 therefore becomes logic "1" and is supplied to a reset terminal RST of the counter IC6, so that the counter IC6 is reset and all of the output terminals Q1, Q2, Q3 and Q10 become logic "0".

Therefore, when the terminal P1 of the comparator IC2 is determined to logic "0", the frequency of the output from the output terminal Q9 of the counter IC6 becomes 38.102 KHz which corresponds to a fraction of 19.6608 MHz of the reference oscillation frequency divided into 516 divisions. On the other hand, when the terminal P1 is determined to logic "1", the frequency of the output becomes 38.028 KHz which corresponds to a fraction of the reference oscillation frequency divided into 517 divisions. However, in a practical circuit, the production of the reset pulse is accompanied by an accumulation of delay of time in each step performed in the counter IC6. A capacitor C3 for adjustment of delay of time is therefore connected to an output terminal of the inverter IC3A so as to provide delay by one clock, so that the frequency of the output from the output terminal Q9 becomes 38.028 KHz which corresponds to a fraction of 517 divisions when the terminal P1 is determined to logic "0", while the frequency becomes 37.955 KHz which corresponds to a fraction of 518 divisions when the terminal P1 is determined to logic "1".

Figure 7:
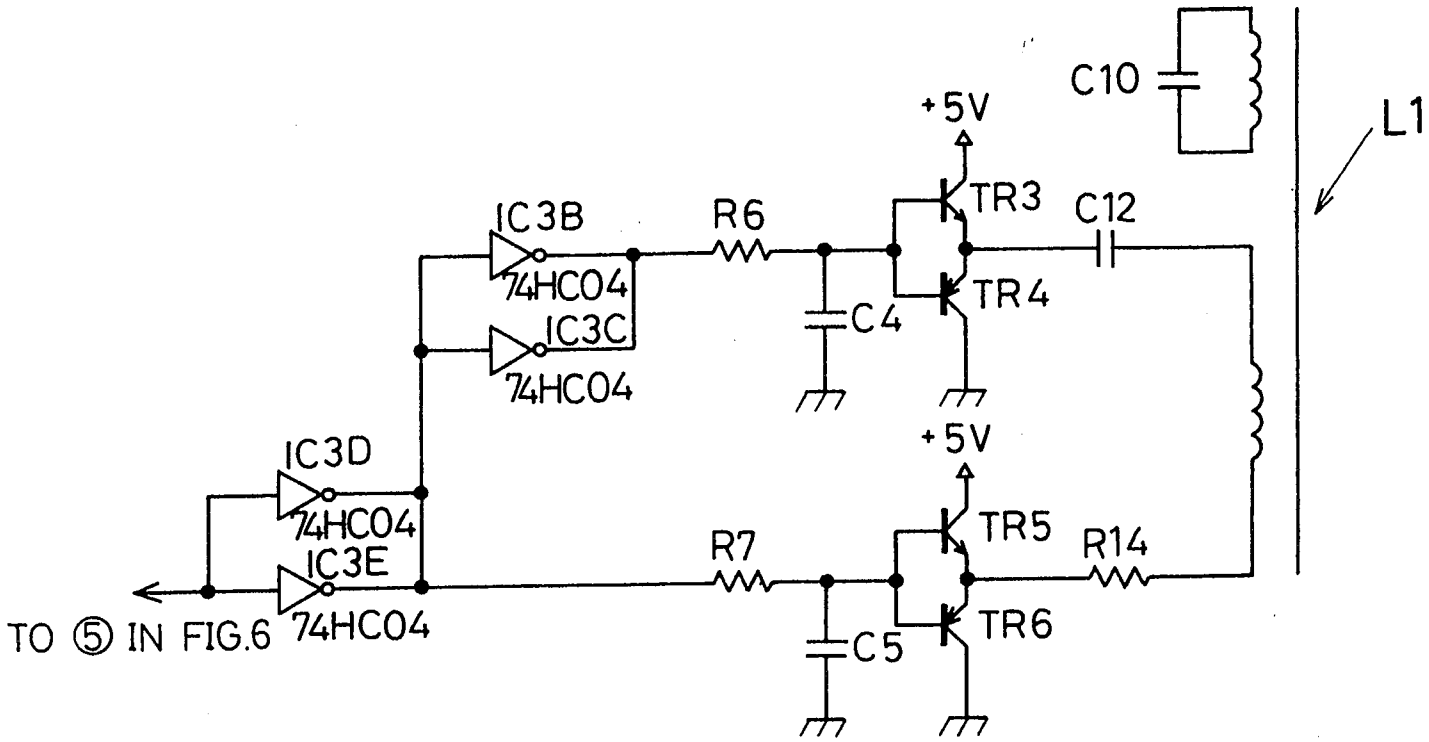
FIG. 7 is a circuit configuration of an output circuit.

An output circuit shown in FIG. 7 will now be explained. The frequency-divided signal outputted from the output terminal Q9 as described above is inputted to inverting buffers IC3D and IC3E in the output circuit. The signals outputted from the inverting buffers IC3D and IC3E are inputted to inverting buffers IC3B and IC3C and to transistors TR5 and TR6. The output signals of the inverting buffers IC3B and IC3C are inputted to transistors TR3 and TR4, respectively. The output coil L1 is connected to a BTL circuit constituted by the transistors TR3 and TR4, transistors TR5 and TR6, a capacitor C12 and a resistor R14, so that a magnetic field is produced by the output coil L1 based on the frequency-divided signal of 38.028 KHz or 7.955 KHz from the oscillating circuit.

The control circuit will now be explained with reference to FIG. 8. The mercury switches S1, S2, S3 and S4 disposed in the roll angle sensor 5, the pitch angle sensor 6, and a temperature sensor RT for detecting the temperature of the boring head 1 are connected to a one-chip CPU IC8 which is a main element of the control circuit. The one-chip CPU IC8 includes a ROM, a RAM and an A/D convertor (not shown) therein. A reset terminal RES of the one-chip CPU IC8 is connected to a reset signal output terminal of a reset IC7.

An intermediate tap of the pitch angle sensor 6 is connected to an analog input terminal AN0 of the one-chip CPU IC8. A voltage of +5 V is applied between both terminals of the pitch angle sensor 6, so that the voltage at the intermediate tap becomes 2.5 V when the boring head 1 is at a horizontal position, while the voltage at the intermediate tap varies with the inclination of the boring head 1 from the horizontal position. The battery 8 is connected to an analog input terminal AN1 of the one-chip CPU IC8 via a diode D2 of the power supply circuit. The temperature sensor RT is connected to an analog input terminal AN2. A pulse signal of 300 Hz is outputted from an output port P57 to the counter IC5 of the power-saving circuit. The clock signal of 4.9152 MHz from the crystal oscillator IC4 of the oscillator circuit is inputted to a clock input terminal EXTAL.

The mercury switches S1, S2, S3 and S4 of the roll angle sensor 5 are connected to input ports P40, P41, P42 and P43, respectively. As the boring head 1 is rotated, the mercury switches S1, S2, S3 and S4 are turned, at intervals of an angle of 45°, as follows:

| | S1 | S2 | S3 | S4 |
|---|---|---|---|---|
| 0° | ON | OFF | OFF | OFF |
| 45° | ON | ON | OFF | OFF |
| 90° | ON | ON | ON | OFF |
| 135° | ON | ON | ON | ON |
| 180° | OFF | ON | ON | ON |
| 225° | OFF | OFF | ON | ON |
| 270° | OFF | OFF | OFF | ON |
| 315° | OFF | OFF | OFF | OFF |

The one-chip CPU IC8 controls an output port P56 to modulate its output frequency, according to a predetermined transmission format, based on data obtained through A/D conversion of the outputs from the temperature sensor RT and the pitch angle sensor 6 and on an ON/OFF situation of the mercury switches S1, S2, S3 and S4.

Figure 9:
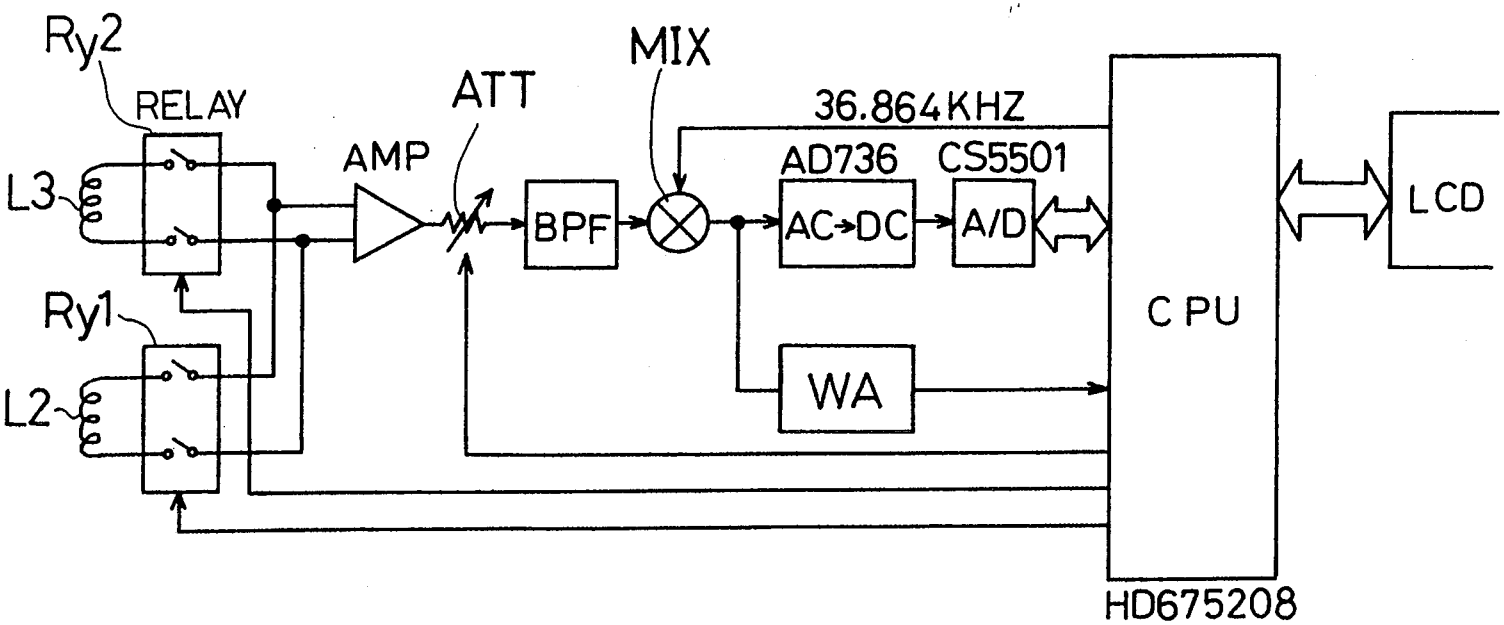
FIG. 9 is a block diagram of a circuit in a receiver.

FIG. 9 is a block diagram showing a circuit configuration of the receiver 21 located on the ground as shown in FIG. 1. As previously described, the receiver 21 includes the receiving coils L2 and L3 for receiving the magnetic field produced by the output coil L1. Electromotive forces generated in the receiving coils L2 and L3 are selectively transmitted to an amplifier AMP via relays Ry1 and Ry2. The amplitude of an amplified signal outputted from the amplifier AMP is adjusted by an attenuator ATT and then, the particular band thereof is cut by a band-pass filter BPF with the necessary band uncut.

An output from the band-pass filter BPF is mixed by a mixer MIX with the signal of 36.864 KHz from the CPU IC8, so that a signal of about 1.1 KHz is produced.

The signal outputted from the mixer MIX is converted into a DC signal by an AC/DC converter AD736 and is thereafter converted into a digital signal by an A/D converter CS5501. On the other hand, the signal outputted from the mixer MIX is inputted to a waveform shaping circuit WA for shaping the waveform and is then inputted to the CPU IC8. Based on the input signal from the waveform shaping circuit WA, the CPU IC8 determines the location, the depth, the temperature, the angle in the roll direction and the angle in the pitch direction of the boring head 1 as well as the remaining amount of the battery 8. These data are displayed on a liquid crystal display LCD.

Figure 10:
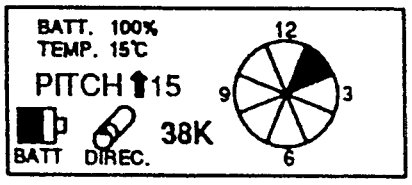
FIGS. 10 to 12 are views showing various images displayed on a liquid crystal display of the receiver.
Figure 11:
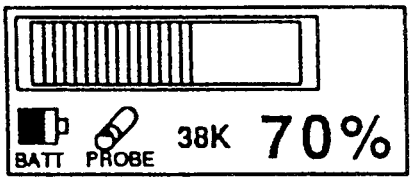
Figure 12:
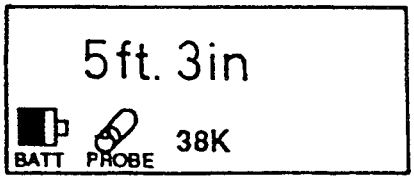

FIGS. 10, 11 and 12 show various images displayed on the liquid crystal display LCD. In the image of FIG. 10, the location of the slant surface 1A of the boring head 1 is displayed by a black-colored segment of one of eight segments of a circle. The pitch angle is displayed by a numeral with an arrow indicating an upward or a downward direction. Thus, if the boring head is inclined upwardly toward its forward end, the arrow indicates the upward direction. The remaining amount of battery (BATT) and the internal temperature (TEMP) are indicated by numerals.

FIG. 11 is the image of display when detecting the location of the boring head 1. As the level of magnetic field received by the receiving coil L2 of the receiver 21 increases, an indication of the location in a bar graph is moved rightwardly while a numeral indicating the location by percentage increases. FIG. 12 is the image of display immediately after starting of detection of the depth.

The operation of the above embodiment will now be explained. Each datum of the roll angle, pitch angle and the temperature detected in the boring head 1, as well as the data for a locating purpose, is modulated in frequency and is outputted in a form of the magnetic field from the output coil L1. Since the dividing ratio of frequency is varied with the change of logic of the terminal P1 of the comparator IC2 of the oscillator circuit from "1" to "0" or vice versa, the frequency of the signal inputted to the output circuit is varied with the change of logic. For this reason, a serial communication is performed with higher frequency taken as logic "1" and with lower frequency taken as logic "0", for example. In a practical detecting operation, an operator pushes a location measuring switch (not shown) of the receiver 21, so that the CPU IC8 selects the receiving coil L2. Then, the operator can measure the position of the boring head I directly above the same and can also measure the direction of boring through searching of a point and a direction at which the level of receiving signal displayed on the liquid crystal display LCD becomes maximum, respectively.

The operator thereafter positions the receiver 21 at a position directly above the boring head 1 and pushes a depth measuring switch, so that the CPU IC8 detects the level of each of the receiving signals of the receiving coils L2 and L3 and calculates the depth from the ground surface to the boring head I based on the ratio of the detected levels. The calculated depth is then displayed on the liquid crystal display LCD. Here, although the frequency-modulation is made for the signal for the locating purpose, the difference of frequency caused by such modulation is relatively small. Therefore, such difference can be taken as being within a tuning frequency of each of the receiving coils L2 and L3. Further, since no change is made in the amplitude, no variation is caused when the signal is converted into the DC signal. Consequently, the measurement of location and the depth can be performed in the same manner as a conventional measuring operation.

The operator subsequently pushes a pitch/roll measuring switch (not shown) so as to measure the pitch angle and the roll angle. If any of the measured location, depth, direction and angles are improper with respect to the planned course, a correction is made by changing the direction of the slant surface 1A. The operator can make such a correction through cooperation with another operator of the boring tool, while recognizing the circle graph of the liquid crystal display LCD. At the same time therewith, the operator can recognize the temperature within the boring head 1 and the remaining amount of the battery 8, so that he can stop the operation to prevent damage to the detecting device if there is anything abnormal.

While the invention has been described with reference to a preferred embodiment, it is to be understood that modifications or variation may be easily made without departing from the spirit of this invention which is defined by the appended claims.

What is claimed is:

1. A device mounted on a boring head of a boring tool for boring the ground and adapted for detecting inclination of the boring head, comprising:

a roll angle sensor for detecting an angular position of the boring head in a roll direction and for outputting a roll angle detecting signal;

a pitch angle sensor for detecting an angular position of the boring head in a pitch direction and for outputting a pitch angle detecting signal;

signal modulating means for converting said roll angle detecting signal and said pitch angle detecting signal into a serial signal and for modulating said serial signal; and output means for receiving said modulated serial signal and for outputting a magnetic field which is receivable by a receiver located on the ground and which permits determination of the roll angle and the pitch angle of the boring head.

2. The device as defined in claim 1 and further including a power supply circuit disposed within the boring head and operable to output a stabilizing voltage; and a power saving circuit operable to stop outputting of said stabilizing voltage when a predetermined time has elapsed after stopping of rotation of the boring head.

3. The device as defined in claim 1 wherein said roll angle sensor includes a plurality of mercury switches spaced from each other in a circumferential direction of the boring head by a predetermined angle; and each of said mercury switches sealingly contains a mercury drop therein and is operable to be turned on and off according to the roll angle of the boring head.

4. The device as defined in claim 1 wherein said pitch angle sensor includes a magnetic variable resistor having an internal resistance varying with the pivotal angle of a pivotal shaft mounted on the boring head; a weight is mounted on said pivotal shaft so as to normally keep said pivotal shaft in position relative to said weight which is directed to a direction of its gravity, so that said pivotal shaft pivots according to the change of the pitch angle of the boring head and that said pitch angle sensor outputs an electric signal according to the pivotal angle of said pivotal shaft.

* * * * *